US005145186A

United States Patent [19]

Maleski

[11] Patent Number: 5,145,186

[45] Date of Patent: Sep. 8, 1992

[54] BROADHEAD FOR AN ARROW AND METHOD OF SECUREMENT

[76] Inventor: Richard Maleski, 4 South St., Plymouth, Conn. 06782

[21] Appl. No.: 637,452

[22] Filed: Jan. 4, 1991

[51] Int. Cl.[5] ..... F42B 6/08

[52] U.S. Cl. ..... 273/422

[58] Field of Search ..... 273/416, 419–423

[56] References Cited

U.S. PATENT DOCUMENTS

| | | | |
|---|---|---|---|
| D. 310,553 | 9/1990 | Kania et al. | D22/115 |
| D. 314,416 | 2/1991 | Rezmer | D22/115 |
| 1,604,713 | 10/1926 | Norlund | 273/421 |
| 2,820,634 | 1/1958 | Vance | 273/421 |
| 2,925,278 | 2/1960 | Sweetland | 273/419 |
| 2,940,758 | 6/1960 | Richter | 273/419 X |
| 3,401,938 | 9/1968 | Bear | 273/421 X |
| 3,614,103 | 10/1971 | Carroll | 273/422 |
| 3,741,542 | 6/1973 | Karbo | 273/422 |
| 3,859,728 | 1/1975 | Shutt | 273/421 X |
| 3,897,062 | 7/1975 | Christensen | 273/421 |
| 4,036,499 | 7/1977 | Sherwin | 273/422 |
| 4,093,230 | 6/1978 | Simo | 273/422 |
| 4,169,598 | 10/1979 | Taylor | 273/127 B |
| 4,210,330 | 7/1980 | Kosbab | 273/422 |
| 4,349,202 | 9/1982 | Scott | 273/422 |
| 4,452,460 | 6/1984 | Adams | 273/422 |
| 4,505,482 | 3/1985 | Martin, Sr. | 273/421 |
| 4,533,146 | 8/1985 | Schaar | 273/422 |
| 4,565,377 | 1/1986 | Troncoso, Jr. et al. | 273/422 |
| 4,570,941 | 2/1986 | Saunders | 273/422 |
| 4,621,817 | 11/1986 | Musacchia | 273/421 |
| 4,643,435 | 2/1987 | Musacchia | 273/422 |
| 4,706,965 | 11/1987 | Schaar | 273/416 |
| 4,772,029 | 9/1988 | Watkins | 273/416 |
| 4,781,386 | 11/1988 | Armitage | 273/422 |
| 4,940,245 | 7/1990 | Bittle, Jr. | 273/416 |
| 4,943,067 | 7/1990 | Saunders | 273/416 |
| 4,944,520 | 7/1990 | Fingerson et al. | 273/419 |

*Primary Examiner*—Paul E. Shapiro

*Attorney, Agent, or Firm*—Dilworth & Barrese

[57] ABSTRACT

A broadhead for an arrow having a locking mechanism which insures true alignment of the longitudinal axis of the broadhead with the longitudinal axis of the shaft of the arrow. The shaft is fit within a longitudinal bore in the body of the broadhead and a locking nut engages external threads at an end of the broadhead which tightens the body of the broadhead about the shaft of the arrow to frictionally engage the arrow shaft within the broadhead body.

21 Claims, 2 Drawing Sheets

BROADHEAD FOR AN ARROW AND METHOD OF SECUREMENT

BACKGROUND OF THE INVENTION

1. Field of the Invention

The present invention relates to broadheads for arrows, and more particularly, to a means for securing the broadhead to the shaft of the arrow. A method of securing the broadhead to the shaft of the arrow is also disclosed.

2. Discussion of the Prior Art

Arrows having broadheads secured by various means to the arrow shaft are well known in the art. Means of securement of the broadhead to the arrow shaft typically include a threaded post which extends from the broadhead which is screwed directly into a tapped end of the arrow shaft or a tapped adapter which is generally secured to the shaft by adhesives, which allows the broadhead to be screwed into the adapter to secure it to the shaft.

Various means for securing the broadhead to the arrow have been developed in an effort to provide an aerodynamically balanced arrow which maintains its accuracy during flight. In addition to the tapped post of the broadhead being screwed into an adapter or into the arrow shaft itself, several other means are provided which include adhesives, crimping, or threaded tubes which secure the broadhead to the arrow shaft by screwing the broadhead into one end of the tube while screwing the arrow shaft into the other end.

Typical securement devices incorporating a threaded post on the body of the broadhead which is screwed into an adapter or directly into the arrow shaft itself are disclosed in, for instance, U.S. Pat. No. 2,940,758 to Richter, U.S. Pat. No. 4,452,460 to Adams, U.S. Pat. No. 3,741,542 to Karbo and U.S. Pat. No. 4,036,499 to Sherwin, among others.

Many other prior art arrows provide a hollow end of the arrow shaft which allows for securement of the broadhead to the shaft by crimping the shaft about a post on the broadhead or a separate post to which the broadhead is also mounted. Arrows of this type are disclosed in, for instance, U.S. Pat. No. 4,533,146 to Schaar, U.S. Pat. No. 4,706,965 to Schaar, U.S. Pat. No. 4,772,029 to Watkins, and U.S. Pat. No. 4,943,067 to Saunders.

Prior means for securement of the broadhead to the arrow shaft such as those disclosed above are subject to several disadvantages which primarily affect the performance of the arrow during use. In particular, the use of an adapter member to secure the broadhead to the arrow shaft end subjects the end of the arrow to the additional weight of the adapter member itself as well as the adhesive or glue used to secure the adapter to the shaft. Furthermore, as is a problem with all threaded engagement means such as the threaded post of the broadhead, as well as the threads required on the adapter or the arrow shaft itself, is that the provision of such threads requires precise machining to insure that the broadhead is firmly secured to the arrow shaft for perfect alignment with the longitudinal axis of the shaft. Any deviation of the longitudinal axis of the broadhead from the longitudinal axis of the shaft will consequently result in an arrow which is improperly balanced and aerodynamically incorrect. The accuracy of the flight of the arrow during use will be compromised to a degree which may mean the difference between hitting or missing a target. A further disadvantage to the use of adapter members lies in the fact that the curing time of the adhesive used to secure an adapter to the shaft slows the assembly process by requiring drying time for the adhesive. Furthermore, if the adhesive is not properly applied, the balance of the arrow may be thrown off which will affect its accuracy during flight.

A disadvantage encountered in the arrows having a broadhead crimped to an end of the shaft is also related to the balance and aerodynamic characteristics of the arrow. If the crimping is not uniform, the longitudinal axis of the broadhead may not align with the longitudinal axis of the shaft and therefore provide an unbalanced and aerodynamically incorrect arrow. Furthermore, the end weight of the crimping member results in an arrow whose forward end is overly weighted, and which will affect performance.

The novel broadhead securement means of the present invention obviates the disadvantages encountered in the prior art and provide an efficient means for securing the broadhead to an arrow shaft which maintains the balance and aerodynamic performance of the arrow. The means for securing the broadhead to the arrow of the present invention also provides a quicker and more efficient assembling process during manufacture.

SUMMARY OF THE INVENTION

The present invention provides a novel means for securing a broadhead to an arrow shaft which maintains the balance and aerodynamic properties of the arrow without adding additional weight to the broadhead end of the arrow. The means for securing the broadhead to the arrow shaft reduces the requirement for exact precision machining present in prior art arrows while providing a precise alignment of the longitudinal axis of the broadhead with the longitudinal axis of the arrow shaft.

The means for securing the broadhead to the arrow shaft of the present invention may be used with any arrow, harpoon, spear or similar device requiring a broadhead attachment to the shaft of the projectile. The perfectly aligned and balanced arrow resulting from the means of securement of the present invention maintains the aerodynamic properties of the arrow and insures accuracy in flight.

The securement means of the present invention essentially comprises a broadhead having a pointed tip at one end and a longitudinal bore at the other end, and provides a plurality of blades on the body portion of the broadhead. The end of the broadhead body at the longitudinal bore is provided with a threaded portion for accepting a locking nut, and preferably at least one axial slot is provided at the threaded portion for tightening purposes.

During assembly, the locking nut is slipped over the arrow shaft and the arrow shaft is then inserted into the longitudinal bore of the broadhead body. As the locking nut is tightened to the threaded portion of the broadhead body, the body is tightened about the shaft by collapsing the body about the shaft at the axial slots. The locking nut is provided with a tapered surface at the entrance to the threads which mates with a tapered portion of the body of the broadhead so that as the nut is tightened the broadhead body is squeezed about the arrow shaft to frictionally secure the shaft within the body. Preferably, at least two axial slots are provided about the threaded portion, so that as the nut is tightened, the body is squeezed about the shaft in a uniform manner to insure that the longitudinal axis of the broadhead is perfectly aligned with the longitudinal axis of the arrow shaft.

Alternately, a ferrule or ring may be provided as a locking flange about the arrow shaft which is then slid into the longitudinal bore of the body member of the broadhead so that upon tightening of the locking nut the body member is deformed to fit about the ferrule and secure the broadhead to the arrow shaft in a uniform and balanced manner to maintain the alignment of the longitudinal axes of both the broadhead and the shaft. The use of such a ferrule allows for the assembly of an arrow by applying a broadhead to any size shaft having various diameters which still provides for an arrow which is aerodynamically correct and balanced to insure accuracy of flight.

BRIEF DESCRIPTION OF THE DRAWINGS

The foregoing features of the present invention will become more readily apparent and may be understood by referring to the following detailed description of an illustrative embodiment of the broadhead of the present invention and its novel means for securing the broadhead to the shaft of an arrow, taken in conjunction with the accompanying drawings, in which.

DETAILED DESCRIPTION OF THE PREFERRED EMBODIMENT

Figure 1:
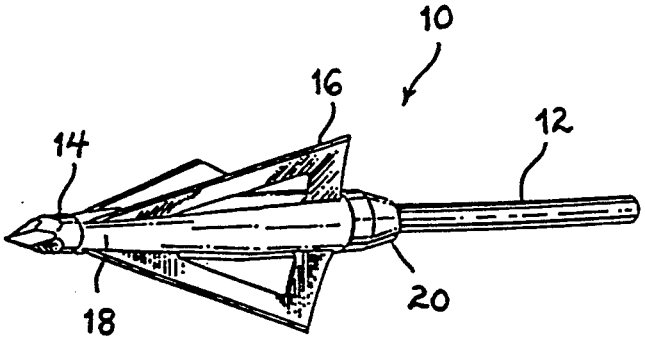
FIG. 1 illustrates a perspective view of an arrow having the broadhead of the present invention secured to a shaft.

Referring now in specific detail to the drawings, in which like reference numerals identify similar or identical elements throughout the several views, FIG. 1 shows the broadhead 10 of the present invention secured to a shaft 12. Broadhead 10 includes a pointed tip 14 at one end which is attached to a body portion 18 along with blades 16. The broadhead 10 is secured by a locking mechanism 20 to the shaft 12 of the arrow.

Figure 2:
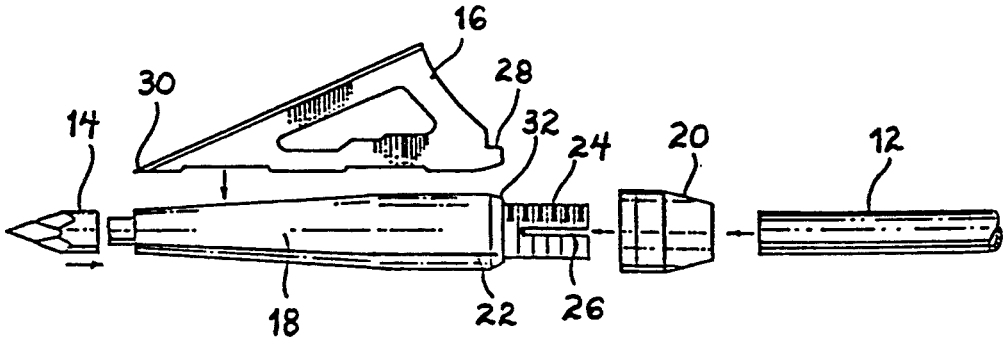
FIG. 2 illustrates a partial exploded view of the broadhead of the present invention having its novel means for securing the broadhead to the shaft of the arrow.
Figure 3:
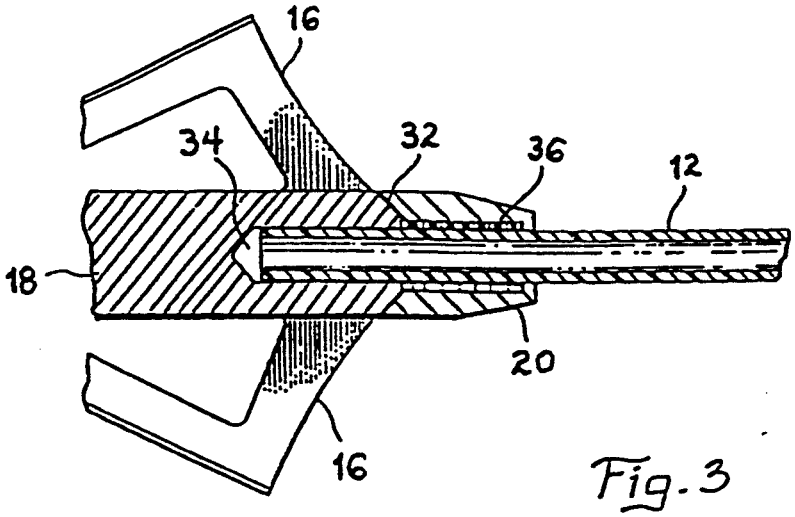
FIG. 3 illustrates a partial cross-sectional view of the assembled broadhead and shaft of the present invention.

FIG. 2 shows the assembly of broadhead 10 to shaft 12, and FIG. 3 shows a cross-section of the fully assembled arrow. As seen in FIGS. 2 and 3, pointed tip 14 is fit onto body member 18 of broadhead 10 so that front edge 30 of blade 16 fits under an edge of pointed tip 14. Blades 16 are secured in slots 22 in body member 18 in a conventional manner. Notch 28 is provided at the rear end of blade 16 for engagement with locking nut 20 to secure blade 16 in the fully assembled broadhead.

As seen in FIG. 3, shaft 12 passes through locking nut 20 into a longitudinal bore 34 of body member 18. As shaft 12 is fit within longitudinal bore 34, locking nut 20 is rotated for engagement with threads 24 of body member 18. Axial slot 26 is provided through threads 24, and preferably a pair of slots 26 which communicate with longitudinal bore 34. As locking member 20 is rotated, the spacing defined by slots 26 is reduced, and body member 18 at threads 24 is squeezed about shaft 12 to frictionally secure shaft 12 within longitudinal bore 34 as best seen at 36 in FIG. 3.

Body member 18 has a larger diameter at the area adjacent blades 16 than at the area of threads 24, and tapered edge 32 is provided between body member 18 and threads 24. A corresponding tapered edge is provided in locking member 20 so that as locking member 20 is tightened about threads 24, the tapered edges meet to further squêeze body member 18 about shaft 12 to frictionally secure the shaft within the body member. Engagement of the ledge 32 with locking member 20 is best seen in FIG. 3.

Figure 4:
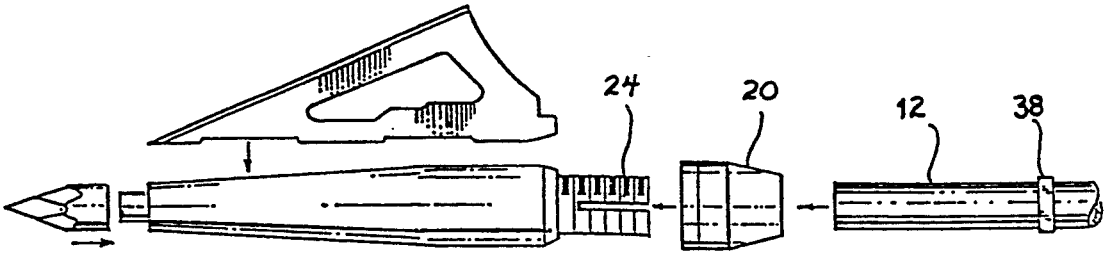
FIG. 4 illustrates a partial exploded view of an alternate embodiment of the present invention.
Figure 5:
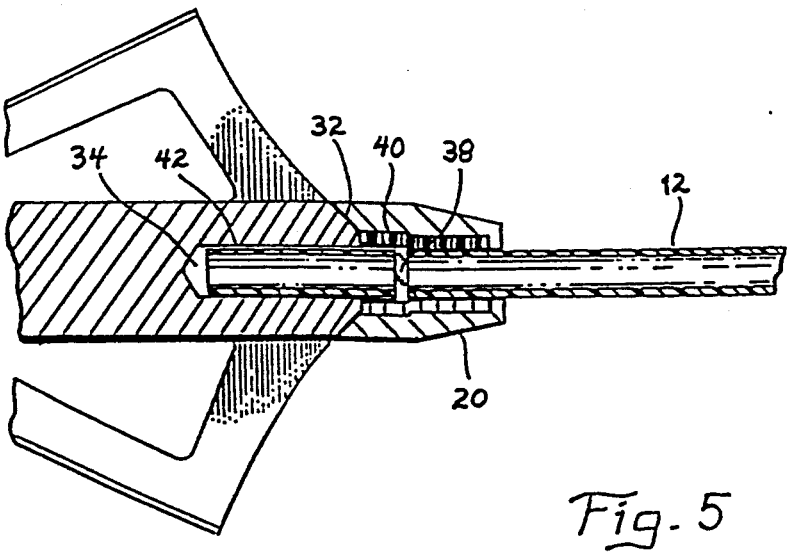
FIG. 5 illustrates a partial cross-sectional view of the broadhead of FIG. 4 showing its securement to the shaft of an arrow.

FIG. 4 illustrates an alternate embodiment of the broadhead securement means in which a shaft having a diameter which is less than a diameter of longitudinal bore 34 may be secured to the broadhead without compromising the alignment of the longitudinal axis of the broadhead with the longitudinal axis of the shaft. The embodiment of FIG. 4 provides a ring or ferrule 38 which is slipped about shaft 12 which approximates the diameter of longitudinal bore 34. As seen in FIG. 5, a space 42 exists between body member 18 and shaft 12 when the shaft is inserted into the broadhead. In use, locking member 20 is slipped over shaft 12 followed by ferrule 38, which may comprise a metallic member or an 0-ring constructed of, for instance, a nylon or other hard plastic material. Ferrule 38 may also be provided with a slot which allows for the adjustment of the ferrule about the shaft 12.

Shaft 12 is then slipped into longitudinal bore 34 so that ferrule 38 is inside the bore at threaded portion 24. When locking member 20 is rotated about threads 24, body member 18 deforms about the ferrule 38 as shown at 40 to frictionally lock shaft 12 within body member 18. Tapered edge 32 allows locking member 20 to be tightened securely to insure the alignment of longitudinal axes of the broadhead and the shaft to insure balance and aerodynamic alignment.

While the invention has been particularly shown and described with reference to the preferred embodiments, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. An arrow comprising a shaft and a broadhead frictionally secured to said shaft, said shaft being fit within a longitudinal bore of said broadhead, and secured to said broadhead by a rotational locking member which upon rotation tightens said broadhead about said shaft to frictionally secure said broadhead to said shaft.

2. An arrow according to claim 1, wherein said broadhead is provided with at least one axial slot in communication with said longitudinal bore, said slot defining a first gap prior to rotation of said locking member, and said slot further defining a second gap after rotation of said locking member, said first gap being greater than said second gap.

3. An arrow according to claim 1, wherein an end of said broadhead adjacent said bore is provided with external threads which cooperate with internal threads on said locking member to tighten said broadhead to said shaft.

4. An arrow according to claim 1, wherein said bore extends a portion of the length of said broadhead, said bore having a diameter greater than an outer diameter of said shaft.

5. An arrow according to claim 1, wherein said shaft includes a flange adjacent an end of said shaft which is fit into said bore of said broadhead, said locking member tightening said broadhead about said flange to frictionally secure said broadhead to said shaft.

6. An arrow according to claim 5, wherein said flange comprises a ferrule which is fit about said shaft.

7. An arrow according to claim 6, wherein said ferrule is provided with an axial slot defining a gap which decreases in width as said locking member is tightened.

8. An arrow according to claim 5, wherein said flange comprises a gasket which is fit about said shaft.

9. An arrow according to claim 1, wherein said broadhead comprises a body member having a plurality of blades, a pointed tip at one end and a threaded region at a second end, said longitudinal bore being at said threaded end, said threaded end cooperating with said locking member for frictionally securing said broadhead to said shaft.

10. An arrow according to claim 9, wherein said body member has a first diameter at said blades which is greater than a second diameter at said threads, said first and second diameters being connected by a taper portion, said taper portion cooperating with a taper portion on said locking member to facilitate tightening of said broadhead about said shaft.

11. A broadhead for an arrow comprising:

a body member having a longitudinal bore extending a portion of its length from a first end, said first end having external threads;

a plurality of blades attached to said body member;

a pointed tip attached to a second end of said body member; and a locking member having a longitudinal bore therethrough and internal threads for cooperating with said external threads of said body member;

wherein said broadhead is frictionally secured to a shaft of said arrow through rotational tightening of said locking member onto said body member, said shaft being positioned in said longitudinal bore of said body member and passing through said longitudinal bore of said locking member.

12. A broadhead according to claim 11, wherein said body member is provided with at least one slot at said threads, such that tightening of said locking member decreases a space defined by said slot to tighten said body member about said arrow shaft.

13. A broadhead according to claim 11, wherein said shaft includes a flange adjacent an end fit into said longitudinal bore of said body member, such that rotation of said locking member tightens said body member about said flange to frictionally engage said broadhead to said shaft.

14. A broadhead according to claim 13, wherein said flange comprises a ferrule attached to said shaft.

15. A broadhead according to claim 11, wherein a diameter of said bore of said body member is slightly greater than an outer diameter of said shaft.

16. A broadhead for an arrow having a plurality of blades comprising:

a cylindrical body member having a first and second end, said body member having a longitudinal bore extending a portion of its length from said second end, said second end having at least one axial slot in communication with said longitudinal bore, said second end further having a threaded portion;

a pointed tip attached to said first end of said body member; and a locking member for attaching a shaft of said arrow to said body member;

wherein said arrow shaft passes through said locking member and into said longitudinal bore, said locking member having interval threads which cooperate with said threaded portion of said body member, such that rotation of said locking member onto said body member collapses said second end at said axial slot to frictionally engage said body member about said shaft to secure said broadhead to said shaft.

17. A broadhead according to claim 16, wherein said shaft includes a flange, such that rotation of said locking member tightens said body member about said shaft at said flange.

18. A method of securing a broadhead to a shaft of an arrow, said broadhead having a longitudinal bore at a first end and a pointed tip at a second end, said first end having external threads for engaging internal threads of a locking nut, said method comprising:

passing said shaft through said locking nut and sliding said shaft into said bore; and rotating said nut to tighten said broadhead about said shaft by collapsing said first end of said broadhead about said shaft to frictionally secure said broadhead to said shaft.

19. A method according to claim 18, wherein said first end includes at least one slot to facilitate collapsing of said broadhead about said shaft.

20. A method according to claim 18, wherein said shaft has an outer diameter slightly less than a diameter of said bore.

21. A method according to claim 18, further comprising the step of sliding a ferrule onto said shaft prior to sliding said shaft into said bore.

* * * * *